US012240718B2

(12) United States Patent
Rodriguez et al.

(10) Patent No.: US 12,240,718 B2
(45) Date of Patent: Mar. 4, 2025

(54) METHOD AND APPARATUS FOR SEPARATING AND SPOOLING A PAPER WEB

(71) Applicant: Sandar Industries, Inc., Atlantic Beach, FL (US)

(72) Inventors: Peter Rodriguez, Jacksonville, FL (US); Jason Rodriguez, Jacksonville, FL (US); Craig Austin, Jacksonville, FL (US)

(73) Assignee: Papeltec Overseas, Inc., Atlantic Beach, FL (US)

( * ) Notice: Subject to any disclaimer, the term of this patent is extended or adjusted under 35 U.S.C. 154(b) by 519 days.

(21) Appl. No.: 17/713,235

(22) Filed: Apr. 5, 2022

(65) Prior Publication Data

US 2022/0315369 A1 Oct. 6, 2022

Related U.S. Application Data

(60) Provisional application No. 63/170,597, filed on Apr. 5, 2021, provisional application No. 63/170,598, filed on Apr. 5, 2021.

(51) Int. Cl.
*B65H 19/26* (2006.01)
*B65H 19/28* (2006.01)

(52) U.S. Cl.
CPC ..... *B65H 19/262* (2013.01); *B65H 19/267* (2013.01); *B65H 19/283* (2013.01);
(Continued)

(58) Field of Classification Search
CPC .... B65H 19/28; B65H 19/283; B65H 19/286; B65H 19/262; B65H 19/967;
(Continued)

(56) References Cited

U.S. PATENT DOCUMENTS 2,461,246 A 2/1949 Weyenberg
4,659,029 A 4/1987 Rodriguez
(Continued)

FOREIGN PATENT DOCUMENTS

EP 0728823 A2 * 8/1996 ..... B65H 19/283

OTHER PUBLICATIONS

International Preliminary Report on Patentability, issued Oct. 10, 2023 in correlated International Application No. PCT/US2022/023376.

(Continued)

*Primary Examiner* — Michael R Mansen
*Assistant Examiner* — Raveen J Dias
(74) *Attorney, Agent, or Firm* — Joseph P. Kincart; Tracnik Law PLLC

(57) ABSTRACT

A paper tape turn-up construct including a cover flap and a multi-bend structure to both protect an adhesive layer and to build an optimized elevated structure to present the adhesive layer during initiation of the paper web turn up process. Methods and apparatus to form the constructs and apply the constructs to paper production equipment are also included. The multi-bend paper turn up construct includes layers of adhesive and pulpable substrate with strategically located release materials, such as silicon that enhance a bridging of a gap between a rotating paper web and an empty spool surface.

15 Claims, 14 Drawing Sheets

(52) U.S. Cl.
CPC ..... *B65H 2301/41427* (2013.01); *B65H 2408/236* (2013.01)

(58) Field of Classification Search
CPC ..... B65H 2301/41427; B65H 2301/41428; B65H 2301/4176; B65H 2301/41764; B65H 2301/41766; B65H 2701/376; B65H 2701/377; B65H 2701/1722; B65H 2701/17222; B65H 75/28; B65H 2408/236
See application file for complete search history.

(56) References Cited

U.S. PATENT DOCUMENTS 4,757,950 A 7/1988 Rodriguez
4,783,018 A 11/1988 Rodriguez
5,046,675 A 9/1991 Rodriguez
5,105,944 A 4/1992 Ingalls et al.
5,323,981 A 6/1994 Dionne
5,417,383 A 5/1995 Rodriguez et al.
5,453,141 A 9/1995 Rodriguez
5,542,622 A 8/1996 Biagiotti
5,601,243 A 2/1997 Inagaki
5,637,170 A 6/1997 Rodriguez
5,646,090 A * 7/1997 Tamura ..... B41M 5/52 503/227
5,954,290 A 9/1999 Rodriguez et al.
6,056,229 A 5/2000 Blume et al.
6,443,387 B1 9/2002 Mercer et al.
6,467,719 B1 10/2002 Rodriguez
6,547,178 B2 4/2003 Rodriguuez
6,578,788 B2 6/2003 Rodriguez et al.
7,078,082 B2 7/2006 Adams
7,172,151 B2 * 2/2007 Biagiotti ..... B65H 19/267 242/532.2
7,757,990 B2 * 7/2010 Tiitta ..... B65H 19/28 242/532.2
7,766,273 B2 8/2010 Rodriguez
7,875,152 B2 1/2011 Rodriguez
8,124,209 B2 2/2012 Rodriguez
8,178,181 B2 5/2012 Rodriguez
8,580,062 B2 11/2013 Rodriguez
10,384,900 B2 * 8/2019 Rodriguez ..... B65H 19/102
10,442,648 B2 * 10/2019 Rodriguez ..... B65H 19/102
11,142,382 B1 10/2021 Hayes
11,884,499 B1 1/2024 Austin et al.
2002/0027179 A1 3/2002 Fujiwara et al.
2002/0134879 A1 9/2002 Rodriguuez
2004/0134591 A1 7/2004 Beck et al.
2005/0155714 A1 7/2005 Adams
2005/0194489 A1 9/2005 Rodriguez
2006/0011767 A1 1/2006 Biagiotti et al.
2006/0141216 A1 6/2006 Hartman et al.
2007/0095967 A1 * 5/2007 Biagiotti ..... B65H 19/267 242/532.2
2008/0061183 A1 3/2008 Rodriguez
2008/0113142 A1 5/2008 Rodriguez
2008/0135158 A1 6/2008 Baumli
2008/0149757 A1 6/2008 Tiitta et al.
2009/0022986 A1 1/2009 Wesselmann et al.
2009/0054219 A1 2/2009 Wu
2009/0173819 A1 7/2009 Maddaleni et al.
2010/0104792 A1 4/2010 Rodriguez
2010/0163665 A1 7/2010 Gambini
2011/0133015 A1 6/2011 Gelli et al.
2013/0020427 A1 1/2013 Gelli et al.
2014/0054407 A1 2/2014 Mazzaccherini et al.
2018/0339874 A1 11/2018 Rodriguez et al.
2018/0339875 A1 11/2018 Rodriguez et al.
2022/0204296 A1 6/2022 Rodriguez et al.
2022/0315369 A1 10/2022 Rodriguez et al.
2022/0380158 A1 12/2022 Austin et al.

OTHER PUBLICATIONS

International Preliminary Report on Patentability, issued Oct. 10, 2023 in correlated International Application No. PCT/US2022/023375.

* cited by examiner

METHOD AND APPARATUS FOR SEPARATING AND SPOOLING A PAPER WEB

CROSS REFERENCE TO RELATED APPLICATIONS

This application claims the benefit of U.S. Provisional Patent Application 63/170,597 filed Apr. 5, 2021, and U.S. Provisional Patent Application 63/170,598 filed Apr. 5, 2021, the contents of which are incorporated herein by reference in their entirety.

BACKGROUND OF THE INVENTION

Modern paper manufacturing is typically performed by producing continuous lengths of paper having widths of over 400 inches in some cases, referred to as paper webs, which are wound onto web spools for subsequent converting, storage, transfer or the like.

A winding or spooling operation for a paper web, such as in the case of tissue grades, occurs at high speeds which in some cases, exceeds six thousand (6000) feet per minute. In order to maximize production by minimizing downtime and waste, it is desirable to sever and simultaneously transfer a moving paper web from a full spool which may be called a parent roll onto an Empty Web Spool without stopping, adjusting draws (e.g., the speed differential between the incoming and outgoing web rotating support members that are not driven by a common source) or slowing the movement of the web.

Methods and apparatuses for accomplishing this severing and transfer utilizing what is known as a transfer or Turn-Up tape are known. An early example of such a system is shown in U.S. Pat. No. 2,461,246 to Weyenberg, issued in 1949. Other examples are shown in our U.S. Pat. Nos. 4,659,029, 4,757,950, 4,783,018, 5,046,675, 5,453,141, 5,637,170, and 5,954,290. Further examples and detailed discussion of such equipment, systems and methodologies are present in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062, the disclosures of which are incorporated herein by reference.

A high-speed transfer of lightweight paper webs, such as groundwood papers (including, for example, newsprint) or tissue paper, is more difficult to accomplish due to a weaker structure of such papers. In addition, in systems using adhesive Transfer Tapes for the web transfer, an exposed adhesive side of the Transfer Tape is often contaminated with airborne dust, floating paper fibers and other debris, which are prevalent in an environment for manufacturing the lightweight paper webs. The contamination is detrimental to the adhesion properties of the Transfer Tape, which is weakened or even substantially removed, which can result in a failed transfer.

A failed transfer results in one or more of: lost production, inconsistent winding of the product, inconsistent roll sizes, excessive waste, shorter service life of the fiber cores which are commonly used in tissue making machines, and unsafe operating conditions.

SUMMARY OF THE INVENTION

Accordingly, the present invention provides apparatus and methods overcoming problems related to contamination of an exposed adhesive on a Transfer Tape deployed during a Turn-Up operation. The present invention provides apparatus and methods that enable a Transfer Tape to be dispensed in a desired length suitable for performing a Turn-Up operation while protecting an adhesive surface from contamination.

Therefore, the present invention relates generally in a first sense to the field of devices, apparatus and methods of effecting more reliable and consistent high-speed severing and transfer of a rapidly advancing paper web from a rotating Parent Web Spool onto an Empty Web Spool, and more particularly to improvements of such operations performed with a light density or tissue paper web.

DETAILED DESCRIPTION OF THE INVENTION

Figures 1, 1A:
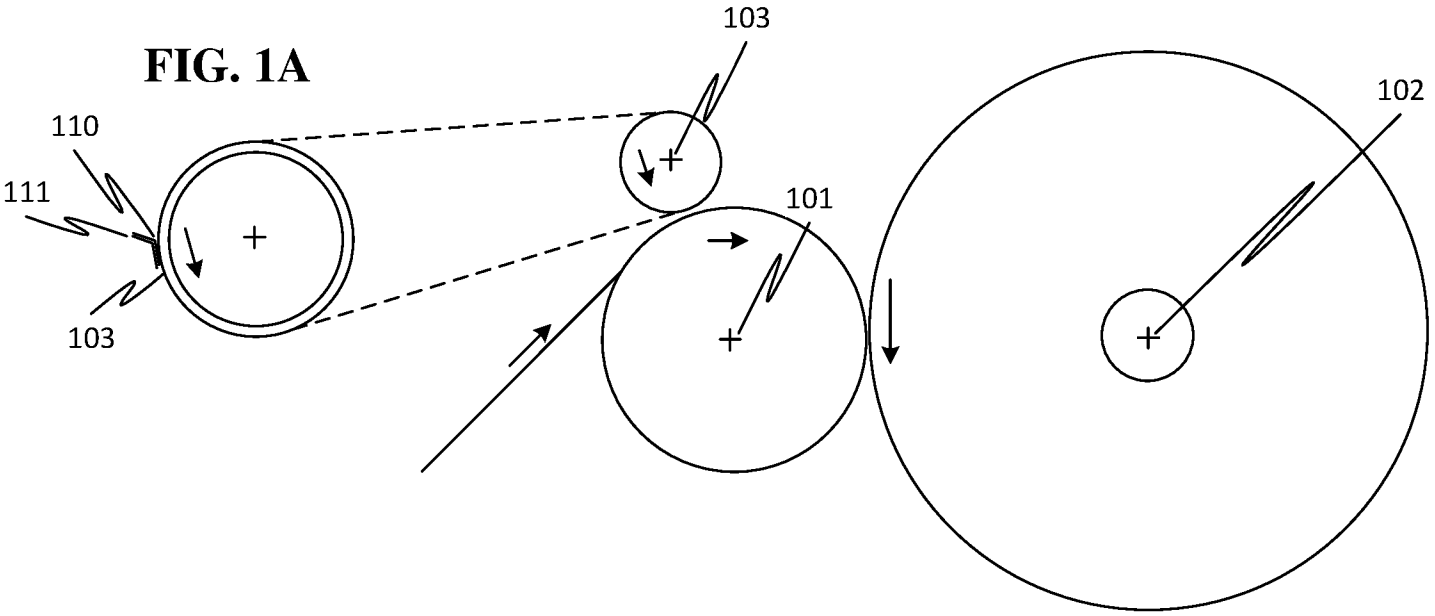
FIG. 1 is an illustration of a paper processing system where an Empty Web Spool has been set up for paper web transfer.
FIG. 1A illustrates an enlarged view of an exemplary Cover Flap transfer paper construct for Turn-Up.

The present invention provides methods and apparatus for producing and for attaching a Cover Flap Transfer Tape Construct which may be used in a paper web Turn-Up operation. The process may facilitate the Turn-Up operation wherein a continuous paper web being rolled onto a Parent Web Roll is severed and transferred to an Empty Web Spool when the Parent Web Spool nears a fully wound state. During operation, a transfer may occur without requiring a flow of the paper web to be temporarily altered or stopped. It is to be understood that disclosure of the apparatus and methods in relation to a paper web Turn-Up operation are exemplary disclosure not meant to be limiting.

Glossary

Cover Flap: as referred to herein refers to a physical layer positioned to mitigate exposure of an adhesive layer to environmental contaminant. During performance of a Turn-Up, at least a portion of the Cover Flap will be moved to expose at least ap portion of the adhesive layer that the Cover Flap protected from environmental contaminant.

Turn-Up: As used herein, a process involving switching a paper web from a nearly completed parent web spool to an empty web spool. A Turn-up process may include severing a paper web from a rotating parent web roll nearing its capacity to hold paper, transferring the paper web to an empty web spool, and securing the paper web to the empty web spool.

Transfer Tape: As used herein a Transfer Tape, sometimes referred to as a turn-up tape, refers to a substrate adapted for extending across a longitudinal cylindrical surface of one or both of an empty web spool and a paper bearing web spool. The transfer tape may include multiple layers.

Web Binding Adhesive: as used herein a Web Binding Adhesive, sometimes referred to as Web Grabbing Adhesive, refers to an adhesive layer of a transfer tape that attaches the transfer tape to a paper web. During paper manufacture and/or processing, a paper web that is attached via web binding adhesive may be pulled to a spool that a transfer tape is adhered to.

Mounting adhesive: as used herein a Mounting Adhesive refers to an adhesive used to bind transfer tape constructs together and/or used to hold a transfer tape construct to a spool.

Pressure Sensitive Adhesive: as used herein a Pressure Sensitive Adhesive refers to a non-reactive adhesive which creates binding force when pressure is applied to attach the adhesive to a surface.

Nip: as used here Nip refers to the area where a paper web or sheet is pressed between two rolls/spools.

Parent Web Roll: as used herein a Parent Web Roll, which may be called an Old Spool, refers to a web spool that is substantially nearing its capacity for holding paper web.

Empty Web Spool: as used herein an Empty Web Spool, sometimes referred to as an Empty Reel, a New Spool, or an Empty Spool, may include a reel that paper web being reeled onto a Parent Roll is transferred to. The surface of an Empty Web Spool is commonly used to adhere a transfer tape upon.

Reel Drum: as used herein a Reel Drum refers to a spool used to drive movement of a paper web; in some embodiments a reel Drum may impart rotational movement to a Parent Roll receiving a paper web in a reeling action.

With reference to the drawings, which are provided for descriptive and illustrative purposes which are not meant to be limiting as the scope of the invention, the invention in various embodiments in a broad and general sense includes apparatus and methods for processing and applying a Cover Flap Transfer Tape Construct which may be used in a paper web turn-up operation. The processes facilitate a turn up operation wherein a continuous paper web being rolled onto a first web spool is severed and transferred to an empty second web spool when the first web spool is fully wound.

In the operation, a transfer may occur without requiring a flow of the paper web to be temporarily altered or stopped. It is to be understood that disclosure of the apparatus and method in relation to a paper web turn-up operation is an exemplary disclosure not meant to be limiting, as the Cover Flap Transfer Tape Construct, methods of its manufacture and associated applicators and methods of application may be suitable for use in different industrial applications.

The present invention provides improved methods of utilizing a Cover Flap Transfer Tape Construct to sever and transfer a continuous paper web from one spool to another spool, such as may be especially useful in transferring lightweight papers such as tissue or newsprint Empty Web Spool. The Cover Flap Transfer Tape Construct may be applied to an Empty Web Spool Nip in a closed position such that the Cover Flap is temporarily adhered in a portion of its surface and opens during the run up in the speed of the spool to which it is attached due both to aerodynamic forces and to centrifugal force. In examples of the present application, the construct is produced so that when the cover flap opens, adhesive layers open with the Cover Flap presenting adhesive off of the surface of the spool. Adhesive layers may be elevated to interact with the paper web.

The Cover Flap Transfer Tape Construct may be produced by assembling layers of structural materials, such as paper, along with layers of adhesive material, such as double stick adhesive tapes. Coatings of various kinds may be applied to the surfaces of the layers to alter properties of the surface. A release layer may be performed by coating a portion of a surface, such as with a silicone coating, that renders the surface as less adherent to an adhesive that may be attached to it. In a non-limiting example, if a portion of a surface of a structural layer is coated with a release coating, then an attached adhesive layer will form a strong bond with the uncoated portion and a weaker bond with the coated portion such that when forces are applied the adhesive will separate from the coated surface and lift up.

Referring to FIG. 1, a starting step of a paper Turn-Up process utilizing the concepts of the present specification is illustrated. In the first (starting) step an operator has prepared the Cover Flap Transfer Tape Construct on an Empty Web Spool 103. The Empty Web Spool 103 may be used to take up the new paper web 100 as it is moved by the Reel Drum 101 in the direction as shown by the arrows. At the starting step, the Empty Web Spool 102 is approaching its capacity to take up the paper web 100. In the inset figure, FIG. 1A an enlarged view of the Empty Web Spool 103 is illustrated, on the surface of the Empty Web Spool is the Cover Flap transfer paper 111 which is held to the Empty Web Spool 103 with an adhesive layer 110.

Figures 2, 2A:
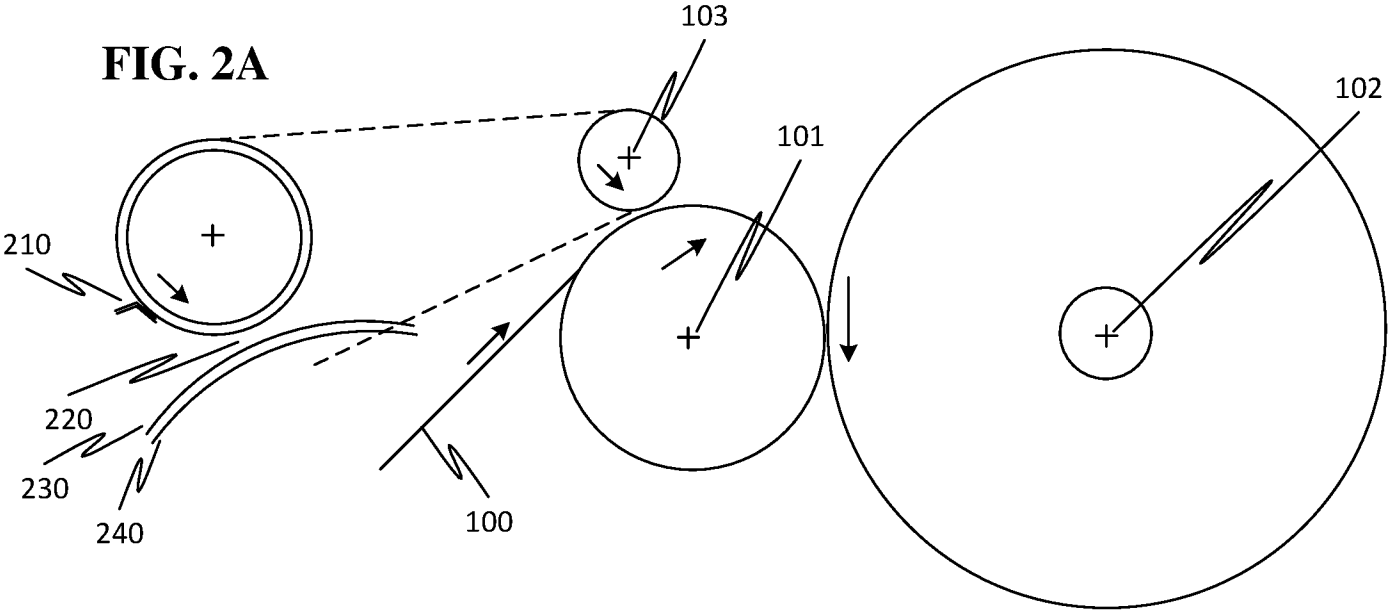
FIG. 2 illustrates a paper processing system with a Cover Flap transfer paper construct approaching the Nip.
FIG. 2A illustrates an enlarged view of an exemplary Cover Flap transfer paper construct as it approaches the Nip.

Referring now to FIG. 2, the Empty Web Spool 103 approaches the Nip as it moves towards the reel drum 101. The paper web 100, is still wrapping to the Empty Web Spool 102. As displayed in FIG. 2A, the deposited Cover Flap Transfer Tape Construct 210 sits on the surface of the Empty Web Spool 103. As the Empty Web Spool approaches the Nip 220 it will contact the paper web 230 which is upon the reel drum surface 240 and be rotated as shown by the arrows. Rotation may be accomplished, for example, via an electric or air powered motor (not illustrated). In some examples, the motor described may bring the Empty Web Spool up to speed prior to it approaching the spool and closing the Nip. The rotary speed (rotations per minute) of the Empty Web Spool may be such that its surface speed equals that of the paper web and reel drum surface. During the run up of that speed, the Cover Flap of the Cover Flap Transfer Tape Construct may open up. The speed of the spool may create an apparent "wind" or aerodynamic force against the surface of the Cover Flap Transfer Tape Construct to open the flap. As well, as the spool rotational speed increases the centrifugal force on the Cover Flap also increases to encourage it to open.

The rotation may bring the opened Cover Flap Transfer Tape Construct 210 into the Nip 220 which will put pressure onto the exposed adhesive surface. In some examples, the cover flap adhesive will approach the paper web when the Empty Web Spool is brought into close contact with the paper web on the reel drum and compresses the Cover Flap Transfer Tape Construct.

Figures 3, 3A:
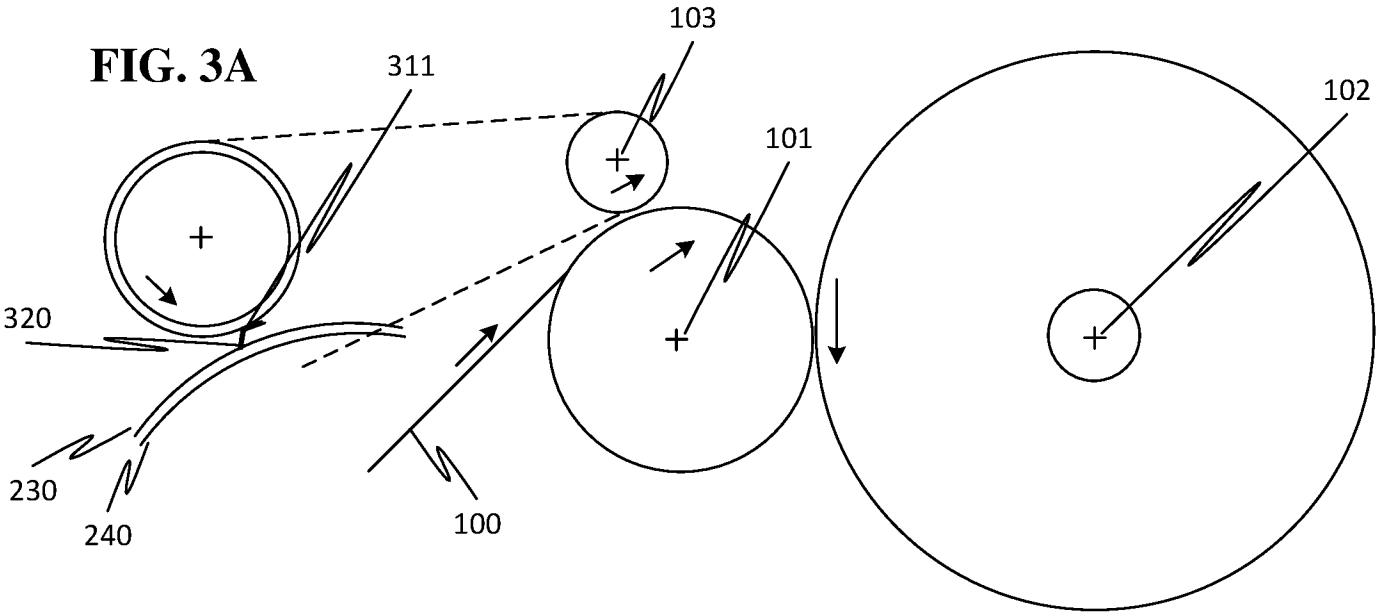
FIG. 3 illustrates a paper processing system where the Cover Flap transfer paper construct are compressed between the Empty Web Spool and the reel drum.
FIG. 3A illustrates an enlarged view of an exemplary Cover Flap transfer paper construct as it is compressed to release adhesive through the tissue paper.

In an example, proceeding now to FIGS. 3 and 3A, when the Cover Flap Transfer Tape Construct is in the Nip 320, the Cover Flap 311 may be pressed to adhere to the paper web 100 in the Nip 320. It may be noted that the proportions of the components in the figures may be exaggerated for the thickness or relative size to the spool and are illustrated for purposes of clarity. Fig.

Figures 4, 4A:
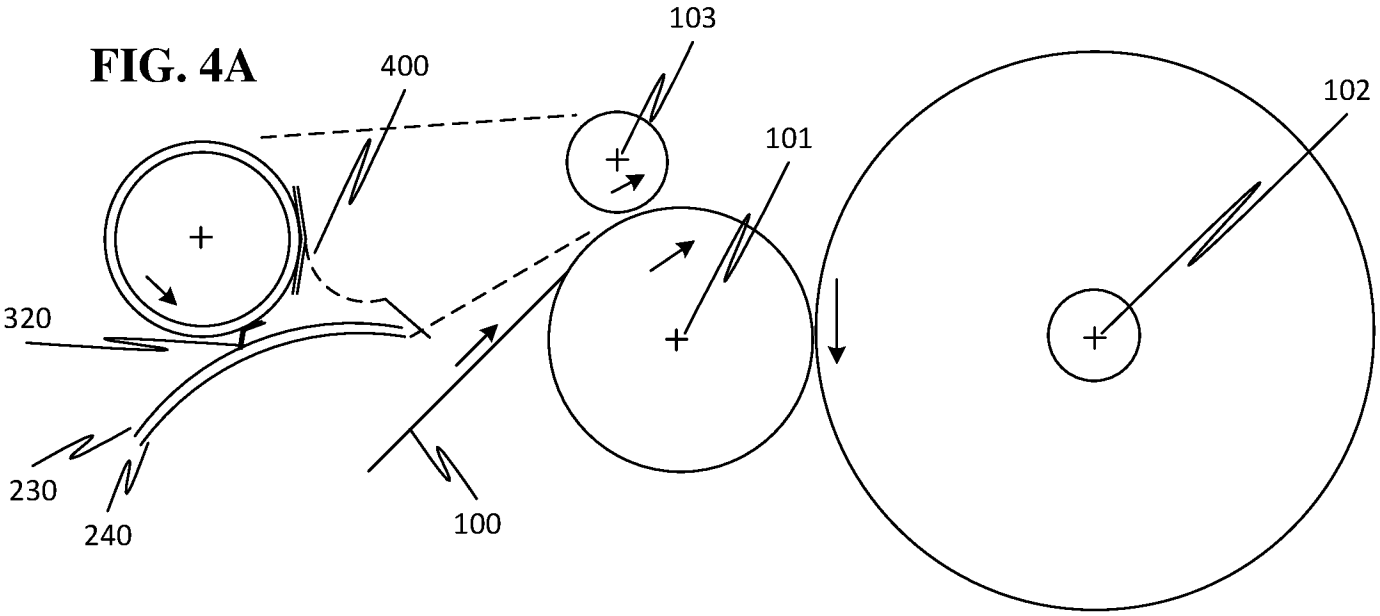
FIG. 4 illustrates a paper processing system where the Cover Flap of the Cover Flap transfer paper construct grabs the advancing paper web.
FIG. 4A illustrates an exploded view of an exemplary Cover Flap transfer paper construct as it grabs the advancing paper web.

Proceeding now to both FIGS. 4 and 4A, the adhesion of the paper web 400 as the reel drum 101 rotates and lifts the paper toward the Empty Web Spool 103. The Cover Flap Transfer Tape Construct location is rotating out of the Nip 320 as new paper from the paper web 230 advances on the reel drum surface 240. As discussed, the illustrations are exemplary and are provided to illustrate fundamental aspects of various embodiments. The scales of the illustrations are not intended to be limiting, such as for example, the relative dimensions of an adhesive layer when compared to paper thickness and spool dimensions.

Figures 5, 5A:
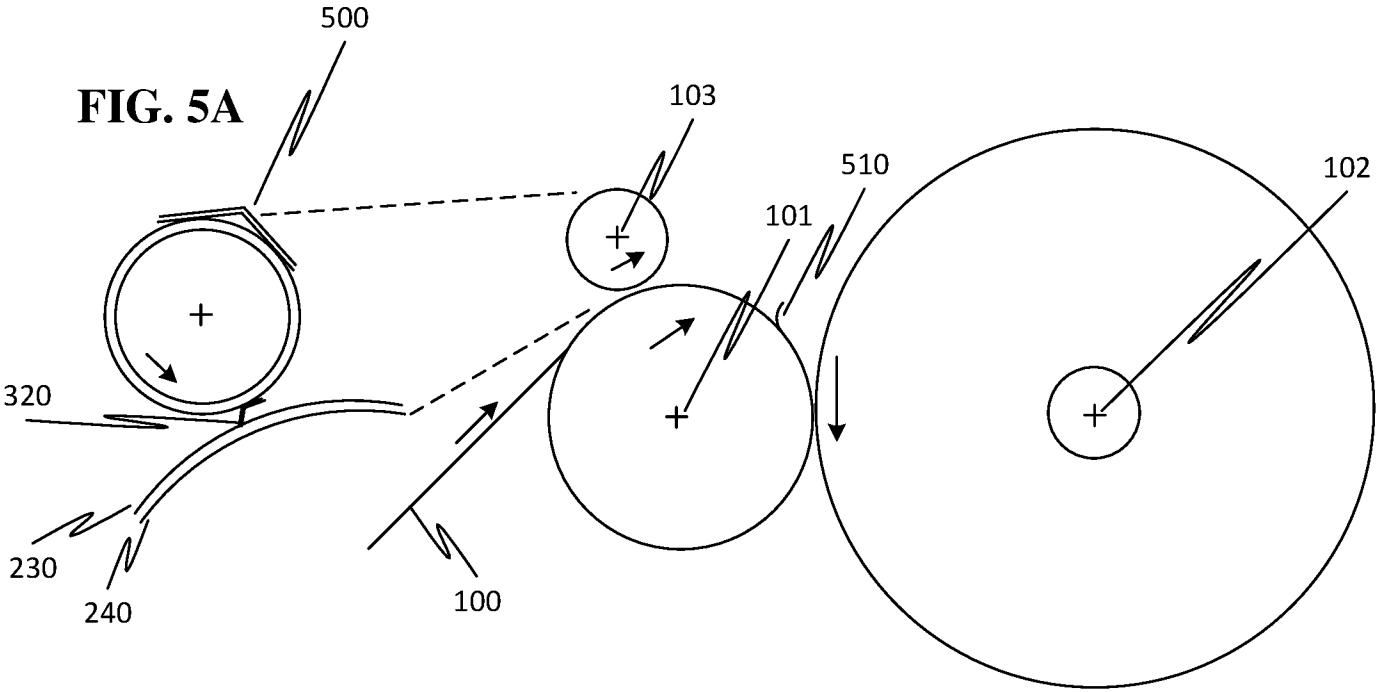
FIG. 5 illustrates a paper processing system where Turn-Up has occurred.
FIG. 5A illustrates an exploded view of an exemplary paper processing system where Turn-Up has occurred.

As illustrated in FIGS. 5 and 5A, as the Empty Web Spool continues to advance with the paper web attached to the adhesive it may eventually tear or burst the paper web 500 away from the last portion 510 of the paper web that is rolling onto the Parent Web Spool. This completes the turnup process. The Empty Web Spool 102 may be moved out of the region of the reel drum 101. As the Empty Web Spool 102 is moved out of the region the Empty Web Spool may continue to pick up paper from the paper web 100 and be moved into the location that the Parent Web Spool had occupied before it was moved.

The Cover Flap Transfer Paper Constructs include an arrangement of a zone-coated carrier paper and adhesive tape that can be adhered to a new spool. A function of a Cover Flap protects the adhesive that will eventually pick up and tear the paper web. The primary problem with applying adhesive tapes to a spool is that the dusty environment will blind the adhesive before it can be delivered to the nip to pick up the paper web. By integrating the Cover Flap the turn-up adhesive may be protected from the environment and contamination of the adhesive until just before it is needed. Various examples of Cover Flap Transfer Tape Constructs are described in following sections.

However, the nature of a combination of multiple layers of adhesive tape, protective liner, and/or carrier paper in assemblies result in structures that resist being wound into a roll suitable for storage, distribution and dispensing. The differential radii among the various layers may create issues such as differences in circumference and wrinkling, that can affect the performance of the system and may cause the system to delaminate.

In a solution a dispenser system can be formed that performs part of the creation of the Transfer Tape structure while dispensing the Transfer Tape and while at the point of dispensing the system to the spool face. Preformed materials may be dispensed from spools with the removal and discarding of unneeded materials during the application process.

For a Cover Flap Transfer Tape Construct a dispensing solution may be achieved by applying a double-sided adhesive tape across the full width of the zone-coated carrier paper and winding the product into a roll. The packaged rolls of liner and adhesive may not be in the final configuration designed to perform the turn-up, and these final steps of the processing may be performed concurrently with the dispensing of the material and application to the spool in the paper mill.

In some examples, the zone coated carrier paper may be formed by treating a carrier paper with a silicone release material to the first face of the carrier paper in longitudinal stripes. When adhesive is applied to the zone coated carrier paper it may permanently adhere to the uncoated stripes, while being impermanently adhered to the coated stripes. In some examples, the second face of the release liner has stripes in an order and placement opposite to those on the first face. In some examples, the adhesive and release liner are laminated together and wound into a roll. Again, the adhesive adheres permanently to the uncoated stripes of the second face of the release liner that has been laid upon the adhesive of the previous layer wound into the roll. In some examples, when the outer-most layer of carrier paper is pulled away from the underlying layer, the adhesive separates into ribbons defined by the alternating coated and uncoated stripes.

In some examples, dispensing and completed processing may be completed by folding the carrier paper in half lengthwise. The outer face on one side of the folded ribbon presents adhesive that adheres the product to the face of the new spool. The product may be oriented with the edges pointing in the direction of spool rotation, while the fold is trailing. In examples without a remaining fold, the similar sides may be oriented in a similar manner.

An outer face of the folded carrier paper may not have adhesive on it. This side may face the paper web as the spool is set for the turn-up. The forward edge of the Cover Flap Transfer Tape Construct as dispensed in this manner may be caught in the air around the spinning spool and lifts up and folds back, exposing the adhesive ribbon that had been protected by the folded carrier paper. Again, in this manner, fresh adhesive may be presented to the paper web when the nip between the empty spool and the reel drum is closed. The paper web may adhere to the exposed adhesive and may follow the circumference of the empty spool. The change in direction ruptures the web in tension and the turn-up may be complete in a process as has been depicted in FIGS. 1-5.

Figure 6A:
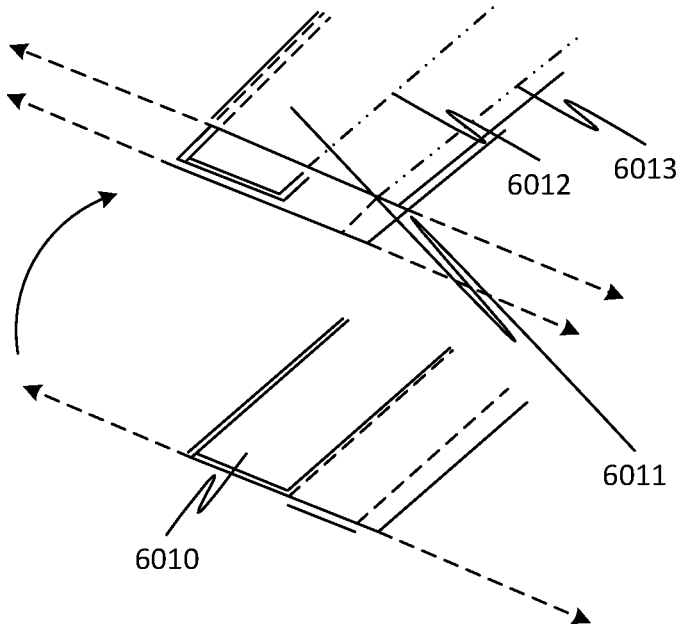
FIGS. 6A-6F illustrates aspects of Transfer Tape construct processing.

An exemplary processing flow to form a Cover Flap Transfer Tape Construct may follow. Referring now to FIG. 6A carrier paper with zone coated release 6010 may be received in a standard roll width. Double sided Adhesive Tape 6011 may be laminated to the first surface of the carrier paper and may be kiss-cut 6012, 6013 at the edges of the coated stripes.

Figure 6B:
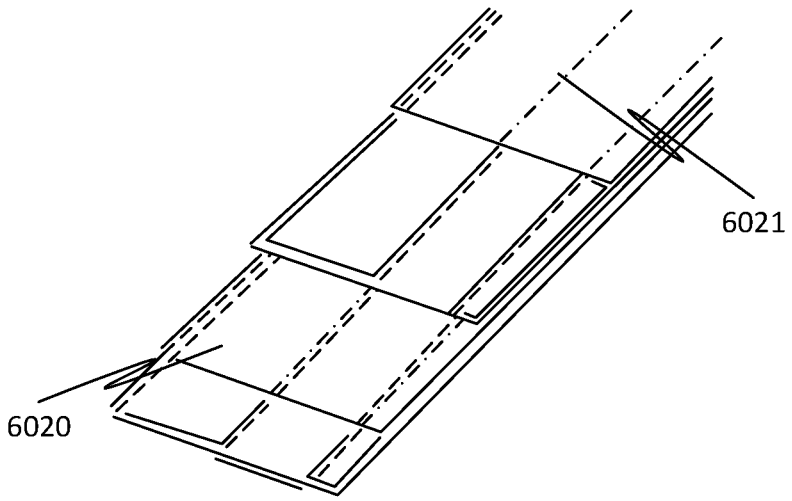

Referring now to FIG. 6B, a wide continuous sheet of double sided adhesive tape which has been laminated to the carrier paper may be slit to a needed width. Separate strips 6020, 6021 of the resulting tape material may be ribbon-wound. In the variations as are illustrated, no release paper is inserted between layers, so the exposed adhesive of the bottom layer is covered directly by the carrier paper of the next layer.

Figure 6C:
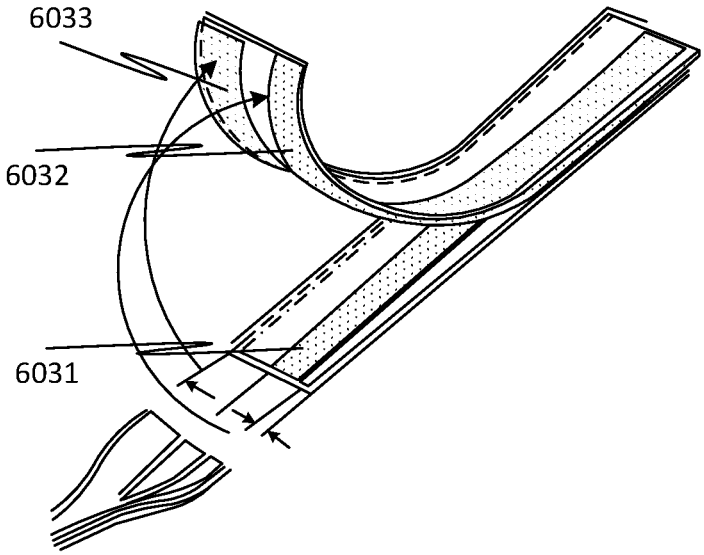

Referring now to FIG. 6C, the dispensing of the zone coated paper and laminated double sided adhesive tape causes ribbons of adhesive adhered to the uncoated areas of the first surface 6031 and transfers ribbons of adhesive 6032, 6033 to the uncoated areas of the second face of a layer pulled from the roll. The double sided adhesive tape may separate into stripes along the kiss-cuts as illustrated.

Figure 6D:
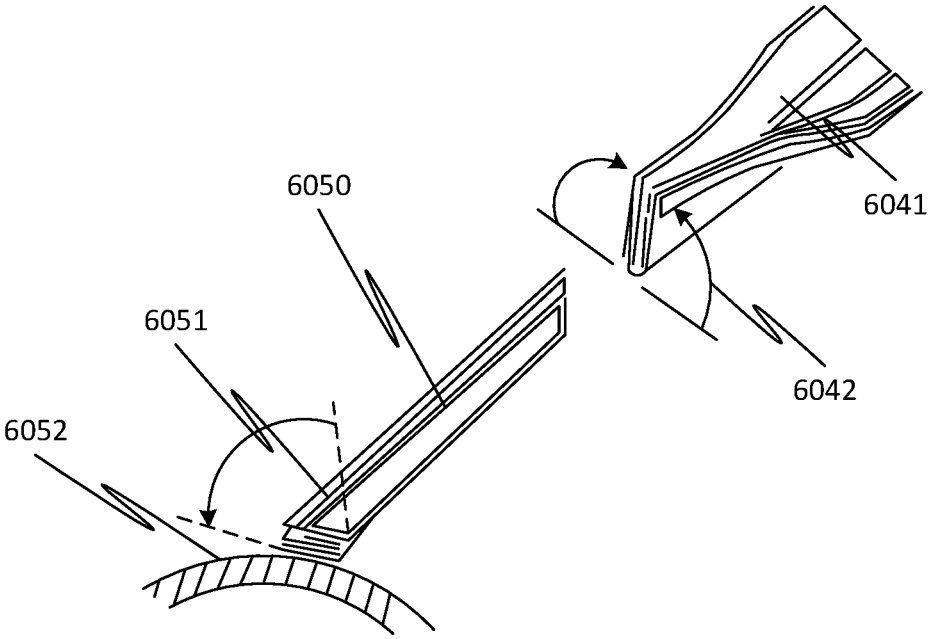

Referring now to FIG. 6D the composite tape strip 6041 may be folded 6042 in half. The strip may be twisted ninety degrees 6050 to attach the strip 6051 to the new spool 6052 by the exposed adhesive. This may result in the strip being firmly adhered to the face of the spool while the adhesive that will pick up the paper web is protected by the upper half of the folded strip. The open side of the folded strip points in the direction of the spool rotation and the fold acts as a hinge around which the upper half will turn when the air around the spinning spool lifts it.

Figure 6E:
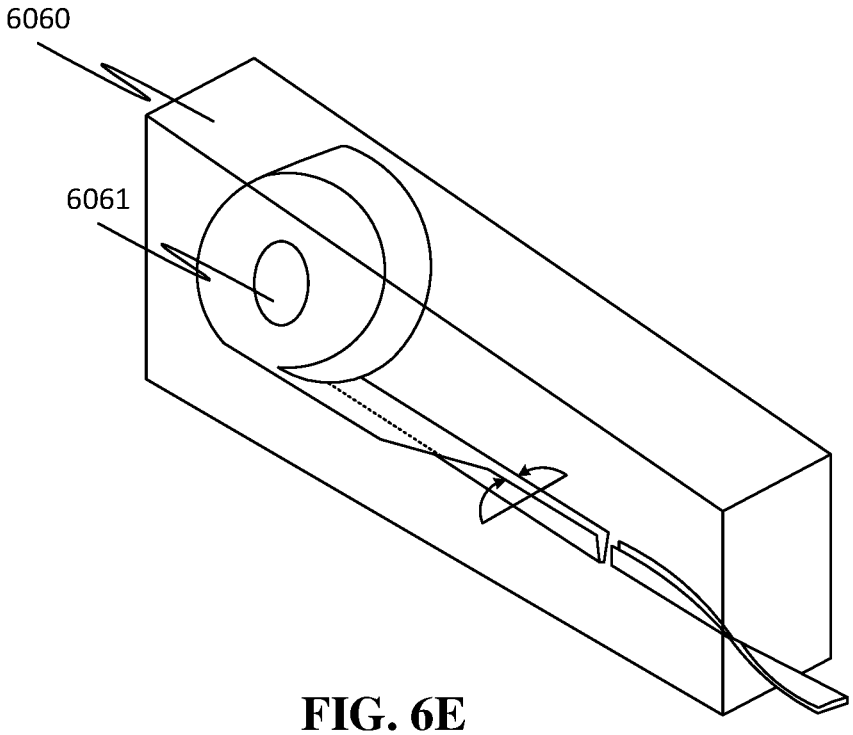

Referring now to FIG. 6E, an applicator package 6060 may contain the roll of prepared carrier paper and adhesive 6061. The applicator package 6060 may be equipped with mechanisms to perform the final processing and application steps to apply the product directly to the spool without manual intervention. The operator may press the leading end of the folded system to the spool and move the applicator package along the length of the spool before the spool is lifted into the primary arms. Thereafter, the applied Cover Flap Transfer Turn-up Construct may function to achieve Turn-Up without further operator action.

Figure 6F:
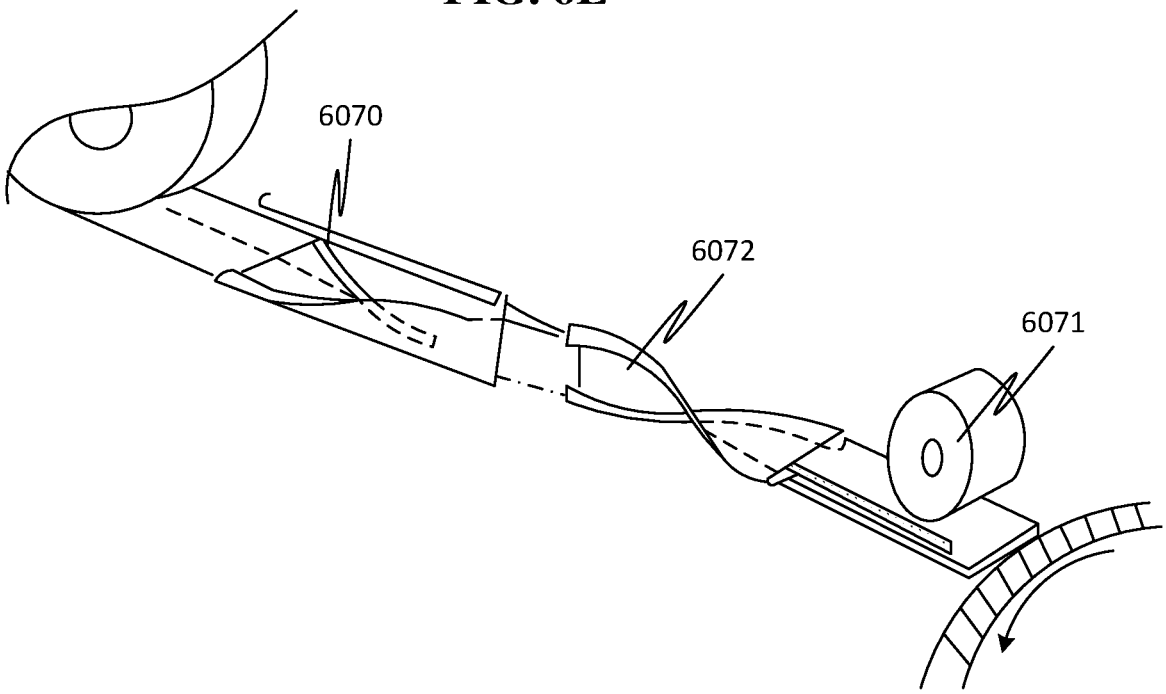

Proceeding to FIG. 6F, the carrier paper and adhesive may be folded lengthwise and twisted before being applied to the spool. FIG. 6F illustrates a 'creasing wire' 6070 in the folding mechanism of the dispenser applicator. In some examples, a wheel may be utilized. In some examples, the creasing wire or the wheel may have a non-stick coating to prevent fouling with adhesive, and non-stick coatings may be common for the remainder of the folding mechanism.

Again, referring to FIG. 6F, a pressing wheel 6071 may be used to firmly press the product to the spool. There may be numerous means to apply pressure to attach the Cover Flap Transfer Tape Construct to the surface such as a wiper or similar apparatus that can apply pressure to the application. In some examples, a compressible polymer foam hub 6072 may provide constant friction and keep the construct well aligned. Other mechanisms may be used to keep the constant friction. Some examples follow to illustrate different ways that the methods and apparatus may be used to create solutions for paper processing turn-up.

Figure 7A:
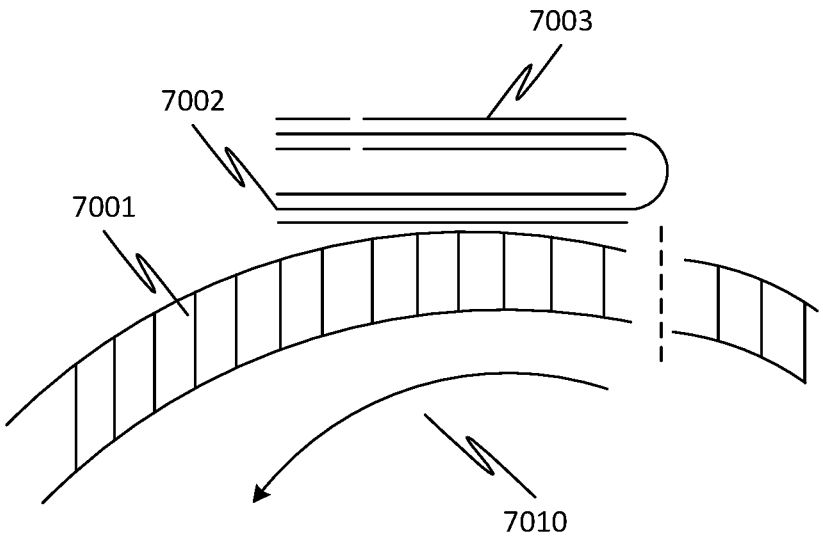
FIGS. 7A and 7B illustrates close ups of aspects of a Turn-Up construct according to some embodiments of the present invention.

Referring to FIG. 7A an illustration of a Cover Flap Transfer Tape Construct 7002 mounted on an Empty Web Spool 7001 is provided. The Cover Flap 7003 is illustrated in an original closed position. The spool may be turned in the direction indicated at arrow 7010. In some examples, spinning of the spool creates one or more of aerodynamic forces and centrifugal forces which act upon the Cover Flap 7003 to pull away from and increase as the rotational velocity of the spool increases. Therefore, the spool may still be rotating at a slower rate which allows for the closed Cover Flap 7003.

Figure 7B:
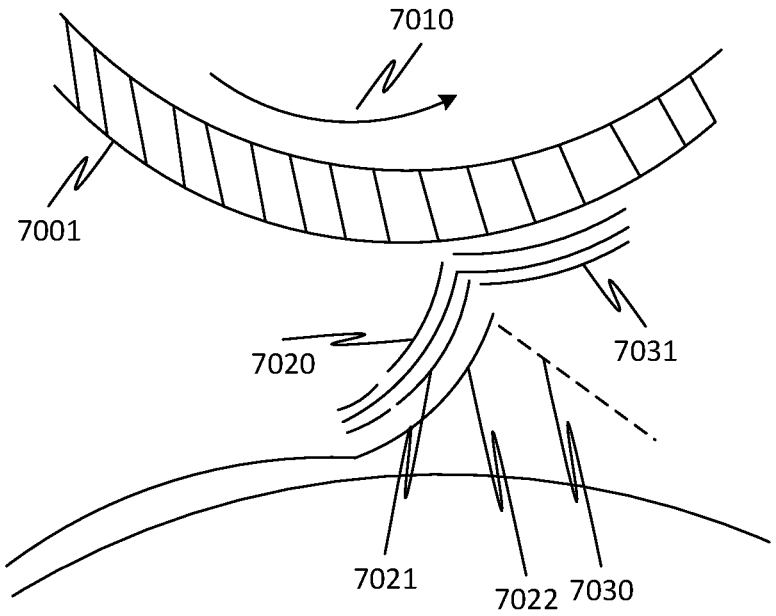

As the spool 7001 reaches a sufficient speed as it rotates in the direction of arrow 7010 the cover flap 7020 may detach from the tape construct and open. Referring to FIG. 7B the flap 7020 is shown in the open position which exposes an adhesive 7021 layer on the underside of the Cover Flap which interacts with the paper web 7022. As the paper web 7022 adheres to the adhesive layer 7021 attached to the Cover Flap 7020, the paper web 7022 may be pulled until the paper web 7021 severs 7030, the severing may include for example tearing of the paper or other separation of fibers included in the paper web until there is no longer a contiguous sheet of paper web 7022.

As has been discussed generally in previous sections, and as can be seen in the illustrations, the rotational movement of the empty spool 7001 causes the flap 7020 to elevated off of the empty spool 7001 and bridge a gap between the empty spool 7001 and the paper web 7022 such that the adhesive 7021 adheres to the paper web 7022. However, prior to elevating off of the empty spool 7001, the adhesive 7021 is protected by the cover flap 7020 and is not exposed to sufficient particles (such as for example paper particles) and other air borne environmental contaminants to significantly impair the adhesive qualities of the adhesive 7021 until the empty spool 7001 spins up to speed. A desired spin up speed may be measured as rotations per minute of the empty spool. In some embodiments, the desired spin sup speed rotations per minute will be based upon, such as within 10% of the surface speed of a paper web 7022 that is spinning on a full spool (not shown in FIG. 7A or 7B).

In some embodiments, a release layer 7031 may be coated on a base of the Cover Flap Transfer Tape Construct 7002 to facilitate the adhesive layer 7021 on the cover flap separating from the release layer 7031.

In various embodiments of the present invention, alternate types of Cover Flap Transfer Tape Constructs that may be formed with the methods and apparatus as have been described. In the following sections different examples are described and illustrated to highlight different features and function that may be created.

Figure 8B:
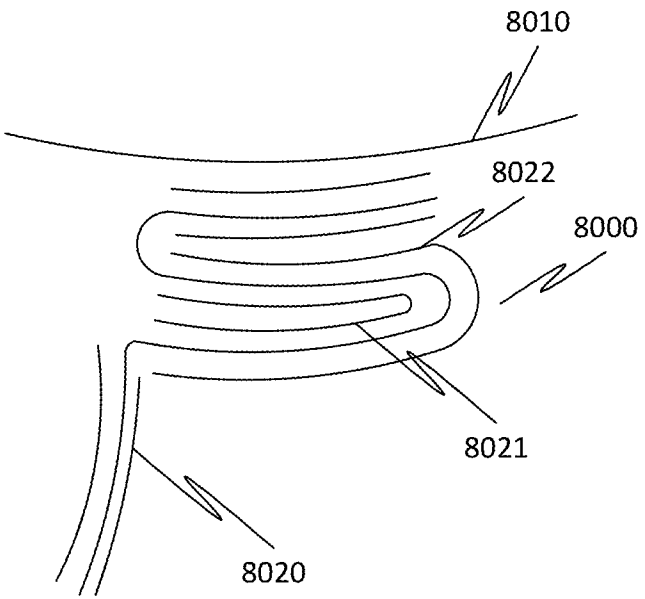
FIGS. 8A-8D illustrate examples of the present invention with adhesive on a Cover Flap.
Figure 8A:
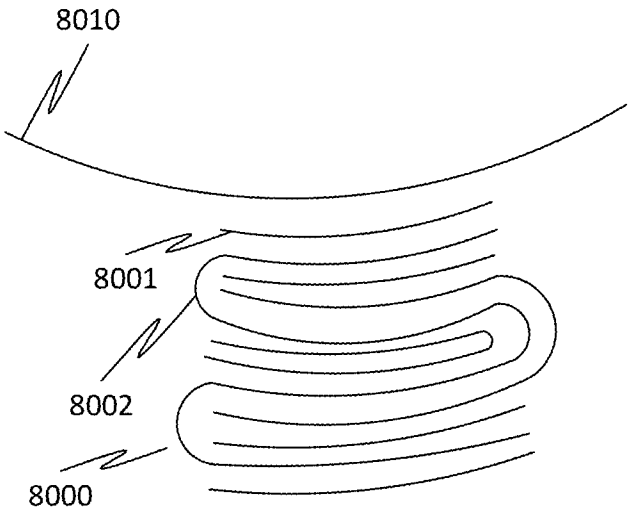

Proceeding to FIG. 8A, an exemplary Transfer Tape Construct 8000 is illustrated in an exemplary position as it would be when applied to an empty spool face 8010, an adhesive 8001 (such as, for example, a pressure sensitive adhesive) is included within the Transfer Tape Construct 8000 and attaches the Transfer Tape Construct to an empty spool face 8010.

Referring now to FIG. 8B, an exemplary Transfer Tape Construct 8000 is illustrated. The Transfer Tape Construct 8000 may include one or more of: an adhesive 8001; a pulpable substrate 8002; a cover flap 8020; adhesive; and release coatings 8021-8022 folded into a cover flap 8020. During operation of a turn up procedure, an empty spool 8010 begins to rotate and increase rotational speed; as the Transfer Tape Construct 8000 begins to respond to the centrifugal forces and/or aerodynamic forces that build as the spool is brought up to speed to match a speed of a paper web spinning on a full spool and other paper web processing elements.

For illustration purposes, the Transfer Tape construct 8000 is illustrated where the empty spool 8010 has begun to rotate up to speed in a counterclockwise direction. Whereas rotation in either direction may generate a roughly equal centrifugal force upon the Transfer Tape Construct 8000 body for a given speed, the counter-clockwise rotational fashion may create the aerodynamic force to open a cover flap 8020 in the manner as illustrated.

As the illustration shows the speed of the empty spool 8010 may be just enough to begin to generate forces to start breaking the bonds in a weaker interlayers formed by release coatings 8021-8022. In these initial stages, the layers of Transfer Tape Construct 8000 may be kept in position by the interfaces between the release coats 8021 and 8022 adhesive 8001 that bond with each other in tenuous bonds. As the spool continues to increase its speed of rotation, the outermost layers of the cover flap 8020 may begin to unfurl the Transfer Tape Construct.

Figure 8D:
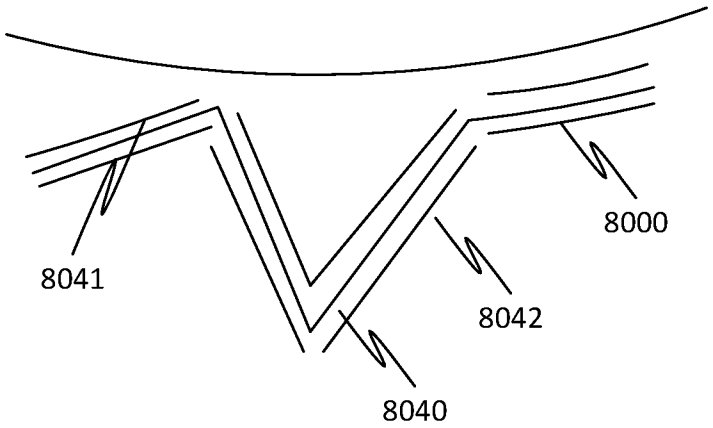
Figure 8C:
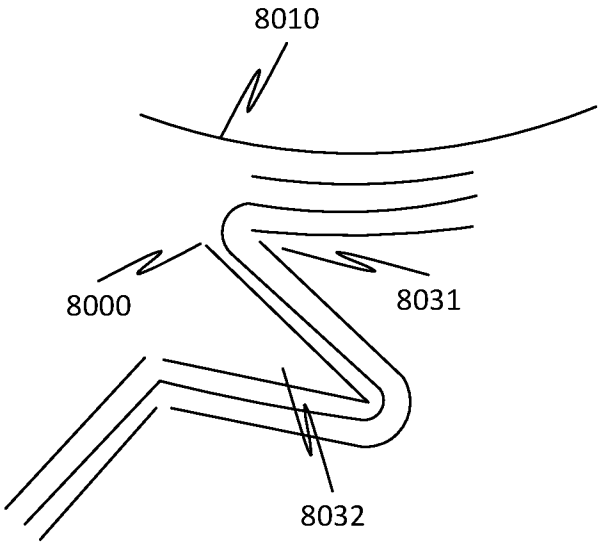

Proceeding to FIG. 8C an illustration of the Transfer Tape Construct 8000 shows exemplary subsequent unfurling of the product. Increased spool rotational speed may increase both the forces and influence of centrifugal and/or aerodynamic forces. The increased forces may tend to cause the interfaces 8031 and 8032 to begin to separate. These interfaces have one or more zone coated release layers that provide for a weaker bonding of adhesives. Thus, the Transfer Tape Construct 8000 is unfurled to a significant degree.

Referring to FIG. 8D, the fully deployed Transfer Tape Construct 8000 is illustrated. The nature of the folded paper carrier may cause a peak 8040 in the product. In some examples, the first exposed surface 8041 of the cover flap may lay back against the spool as illustrated. The resulting structure may have the peak which may create a collapsible element that spans the gap of an open nip between the reel drum and spool. The triangular shape, that the construct may form, may provide support for an adhered structure that presents the adhesive web of primary interest for picking up a paper web, which is that surface facing in the direction of spool rotation 8042.

Figure 9A:
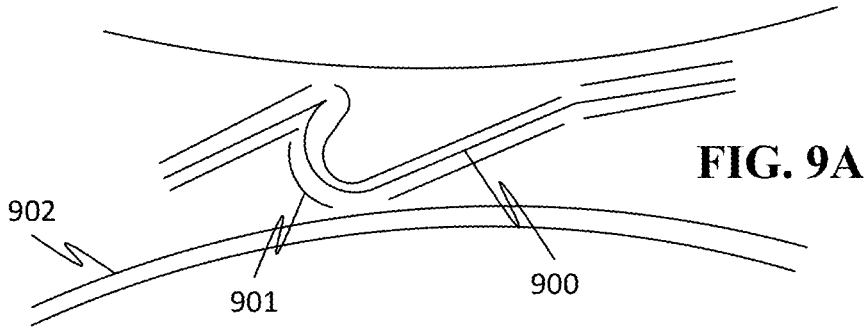
FIGS. 9A-9C illustrate examples of some embodiments of the present invention with adhesive on a Cover Flap.

Referring to FIG. 9A, as the attached Transfer Tape Construct 900 approaches a nip and the paper web it may be significantly compressed by the interaction in a process that folds the peak onto other portions of the Transfer Tape Construct 900. Initial stages of collapse of the Transfer Tape Construct 900 as adhesive 901 on the structure begins to interact with the paper web 902 is illustrated in FIG. 9A. The collapse of the Transfer Tape Construct as the spool approaches the reel drum allows additional surface area of adhesive layer to contact and bond with the paper web. The structure may be useful to bridge the surfaces especially in the condition where defects in a spool cover (generally, a fiber core spool cover) prevent a complete nip across the full width of the paper web.

Figure 9B:
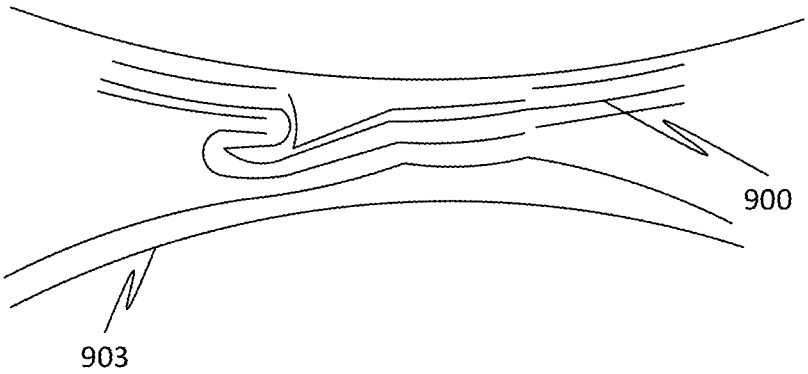

Referring next to FIG. 9B, an illustration of the complete crushing of the Transfer Tape Construct 900 as the spool 903 makes intimate contact with the reel drum, especially in the condition where the defects in the spool cover make first contact with the reel drum and web.

Figure 9C:
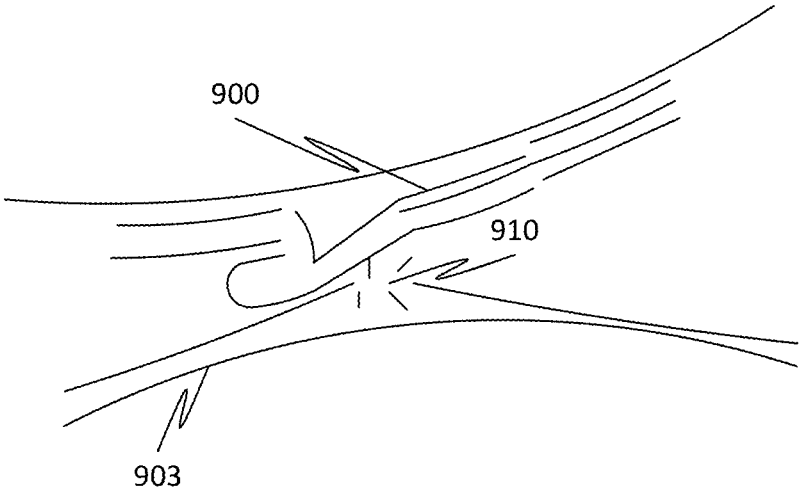

Proceeding to FIG. 9C, an illustration of the Transfer Tape Construct 900 as it picks up the paper web 902 is provided. As the paper web is pulled to the Empty Spool it places the paper web under tension which causes it to burst 910 in tensile failure and severs the paper web via separation of fibers included in the paper web, after which the web is pulled around the Empty Spool for the desired turn-up.

Figure 10:
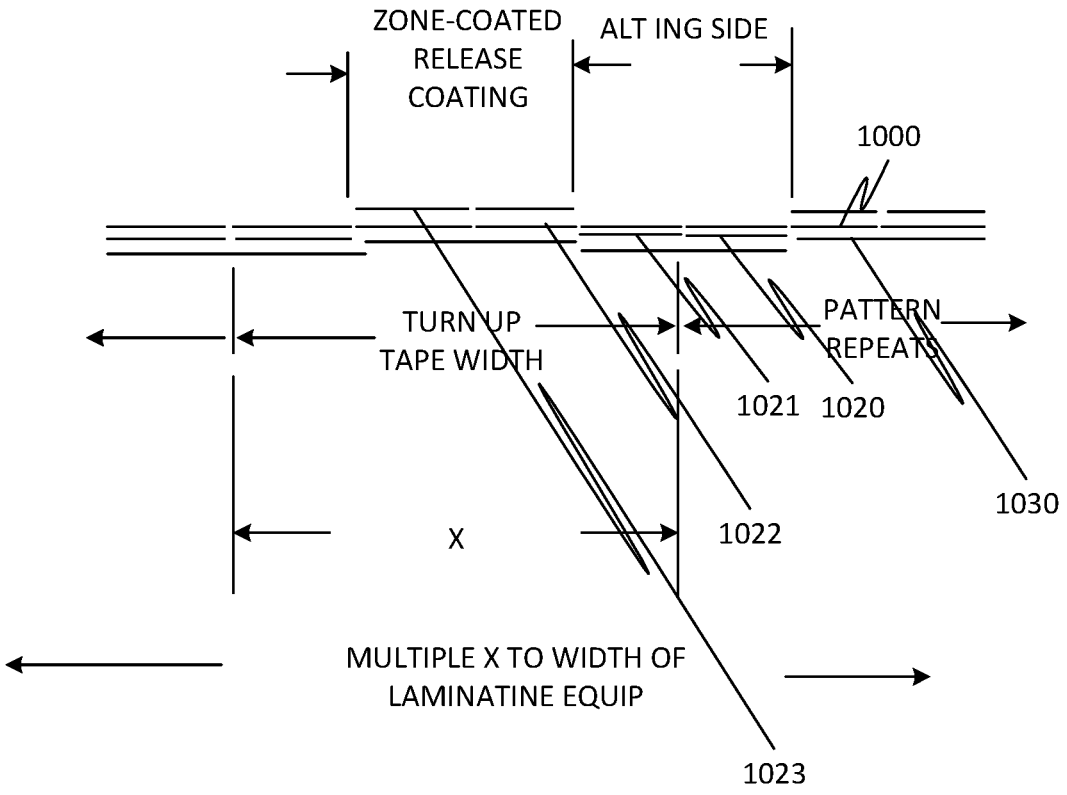
FIG. 10 illustrates an example of some embodiments of the present invention with adhesive on a Cover Flap.

FIG. 10 illustrates an example of a configuration of an adhesive web and a zone-coated carrier paper that enables the self-converting nature of the elements of the example Transfer Tape Construct when dispensed at the time of use. The carrier paper is preferably a pulpable material. In an example, a carrier paper 1000 bearing a repeating pattern of stripes of release coating 1020, 1021, 1022, 1023 on opposite faces may be laminated to a continuous web of double-sided adhesive film 1030. The film may be subsequently slit to the desired width, and kiss-cut at about ¼ and ¾ of the desired width.

Figure 11:
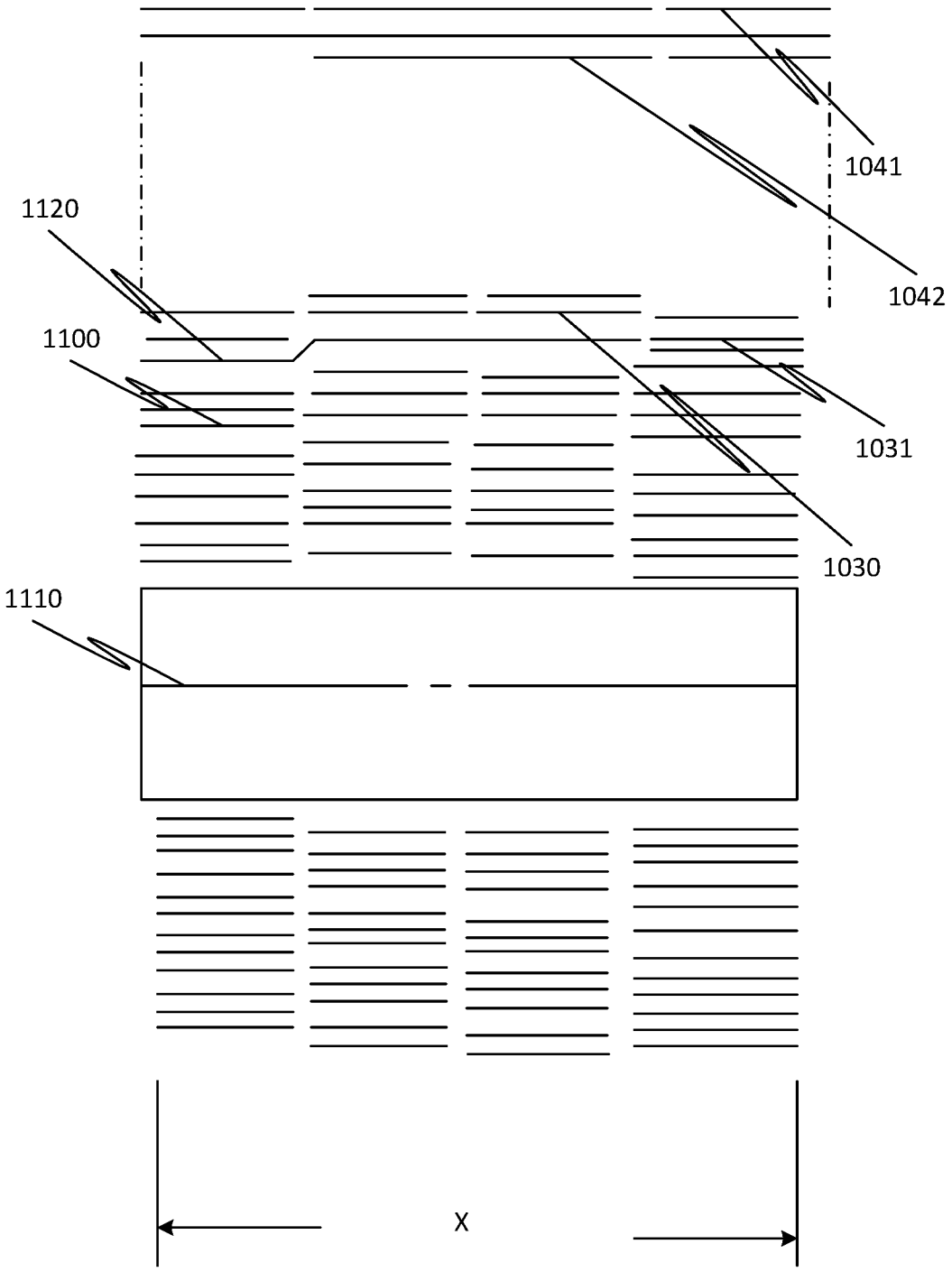
FIG. 11 illustrates an example of some embodiments of the present invention with adhesive on a Cover Flap.

Referring to FIG. 11, the laminated processed carrier paper as described in FIG. 10 may be wound around a spool. The illustration of FIG. 11 depicts a cross section of the material 1100 being wound around a spool 1110. When wound on a spool, as shown in FIG. 11, the adhesive web 1120 adheres more to the uncoated zone, 1030 for example, of the carrier paper and less-so to the release coating 1031, such that drawing off the outer layer of the product from its spool causes the adhesive web to separate at the kiss cuts. The drawn off product layer may be as illustrated by the dotted lines above the roll. The separation of the adhesive web may leave adhesive where it is tightly bonded to the uncoated zones of the carrier paper above 1041 and below 1042 any given layer of adhesive.

A roll of Transfer Tape may be separated at the point of use by an applicator mechanism. The applicator may have bending and folding mechanisms to fold the product longitudinally into the configuration illustrated earlier in FIG. 8A and applies it to the spool.

Particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

As has been mentioned, the illustrations depict aspects of exemplary embodiments, and the relative scale of illustrated features may be exaggerated for depiction of various aspects. Accordingly, the scale of features illustrated is not intended to limit the scope of the elements of the various embodiments consistent with the present application.

What is claimed is:

1. A method for performing a turn up process on a paper making machine, the process comprising the steps of:

a. mounting a proximal end of a transfer tape construct at a first position on an empty web spool, the transfer tape construct comprising folded layers of: adhesive, release coating, and pulpable substrate;

b. spinning the empty web spool and the transfer tape construct mounted on the empty web spool at a rotation speed sufficient to cause one or both of: aerodynamic forces and centrifugal forces to separate interfaces formed by the release coatings and adhesive;

c. as a result of the aerodynamic forces and centrifugal forces acting on the transfer tape construct, separating a cover flap and an adhesive layer at a distal end of the transfer tape construct from a release coating;

d. forming a peak with the pulpable substrate and the adhesive layer;

e. with the peak comprising the pulpable substrate and the adhesive layer, bridging a gap between the empty web spool and a surface of a paper web rotating on a full web spool;

f. adhering the adhesive layer to the paper web; and g. continuing to spin the empty web spool and the transfer tape construct until the paper web severs via separation of fibers included in the paper web.

2. The method of claim 1 additionally comprising the step of continuing to spin the empty web spool and the transfer tape construct following the adhering of the adhesive layer to the paper web and the paper web severs, to form a roll of paper web on the empty web spool.

3. The method of claim 2 additionally comprising the step of attaching the distal end of the transfer tape construct at a second position on the empty web spool.

4. The method of claim 3 additionally comprising the step of protecting at least a portion of the adhesive layer from air borne contaminates with the folded layers of: adhesive, release coatings and pulpable substrate.

5. The method of claim 4 wherein the air borne contaminants comprise paper particles.

6. The method of claim 3, additionally comprising the step of forming the peak comprising the pulpable substrate and the adhesive layer via the attaching of the distal end of the transfer tape construct at the second position on the empty web spool.

7. The method of claim 6, additionally comprising the step of contacting the paper web with the peak comprising the pulpable substrate and the adhesive layer.

8. The method of claim 7 additionally comprising the step of collapsing the peak comprising the pulpable substrate and the adhesive layer via as the empty spool approaches the paper web.

9. The method of claim 8 additionally comprising the step of: following the collapsing of the peak comprising the pulpable substrate and the adhesive layer, contacting and bonding additional surface area of the adhesive layer with the paper web.

10. The method of claim 9 additionally comprising the step of winding the paper web onto the empty spool.

11. The method of claim 10 wherein the release layer comprises a portion of a surface treated with a reduced adhesion strength substance.

12. The method of claim 11 wherein the reduced adhesion substance comprises a silicon based formulation.

13. The method of claim 10 wherein the transfer tape construct comprises a carrier paper with a repeating pattern of stripes of release coating.

14. The method of claim 13 wherein the transfer tape construct comprises multiple kiss-cuts.

15. The method of claim 14 wherein the kiss-cuts are placed at one or both of ¼ and ¾ of a width of the transfer tape construct.

* * * * *